US008474272B2

(12) United States Patent
Yuan et al.

(10) Patent No.: US 8,474,272 B2
(45) Date of Patent: Jul. 2, 2013

(54) MULTISTAGE PULSE TUBE COOLERS

(75) Inventors: Sidney W. K. Yuan, Los Angeles, CA (US); Jee S. Cha, Los Angeles, CA (US)

(73) Assignee: The Aerospace Corporation, El Segundo, CA (US)

( * ) Notice: Subject to any disclaimer, the term of this patent is extended or adjusted under 35 U.S.C. 154(b) by 805 days.

(21) Appl. No.: 12/611,784

(22) Filed: Nov. 3, 2009

(65) Prior Publication Data

US 2011/0100024 A1 May 5, 2011

(51) Int. Cl.
*F25B 9/00* (2006.01)
*F25B 7/00* (2006.01)

(52) U.S. Cl.
USPC ..... 62/6; 62/335

(58) Field of Classification Search
USPC ..... 62/6, 335
See application file for complete search history.

(56) References Cited

U.S. PATENT DOCUMENTS 5,295,355 A * 3/1994 Zhou et al. ..... 62/6
5,412,952 A * 5/1995 Ohtani et al. ..... 62/6
5,953,920 A * 9/1999 Swift et al. ..... 62/6
6,983,610 B1 * 1/2006 Olson ..... 62/6
2007/0000257 A1 * 1/2007 Mita et al. ..... 62/6
2008/0072607 A1 * 3/2008 Haberbusch et al. ..... 62/6
2009/0084114 A1 4/2009 Yuan et al.
2009/0084115 A1 4/2009 Yuan et al.
2009/0084116 A1 4/2009 Yuan et al.
2009/0107150 A1 4/2009 Yuan et al.

FOREIGN PATENT DOCUMENTS

JP 08271070 A * 10/1996

OTHER PUBLICATIONS

Ray Radebaugh, "Development of the Pulse Tube Refrigerator as an Efficient and Reilable Cryocooler," submitted to Proc. Institution of Refrigeration (London), 1999-2000, downloaded from cryogenics.nist.gov/Papers/Institute_of_Refrig.pdf on Nov. 3, 2009.

Gunther Cronenberg, "The Stirling Engine," Mar. 28, 2005, downloaded from cronenberg.cc/gunther/Skripten/Stirling/stirling.pdf on Nov. 3, 2009.

* cited by examiner

*Primary Examiner* — Frantz Jules
*Assistant Examiner* — Joseph Trpisovsky
(74) *Attorney, Agent, or Firm* — K & L Gates LLP

(57) ABSTRACT

Various embodiments are directed to multistage pulse tube coolers. In some embodiments, one or more stages of the pulse tube cooler may comprise a control valve positioned between the hot end of the pulse tube and the reservoir. Also, in various embodiments, one or more inter-stage control valves may be positioned between the pulse tubes of consecutive stages.

20 Claims, 12 Drawing Sheets

MULTISTAGE PULSE TUBE COOLERS

RELATED APPLICATIONS

This application is related to the following applications, which are incorporated herein by reference in their entirety:

(1) U.S. application Ser. No. 12/611,764, entitled, "PHASE SHIFT DEVICES FOR PULSE TUBE COOLERS," and filed on even date herewith; and (2) U.S. application Ser. No. 12/611,774, entitled, "VARIABLE PHASE SHIFT DEVICES FOR PULSE TUBE COOLERS," and filed on even date herewith.

BACKGROUND

Mechanical coolers are devices used for cooling, heating, and thermal transfer in various applications. For example, mechanical coolers are used to cool certain sensor elements, to cool materials during semiconductor fabrication, and to cool superconducting materials such as in Magnetic Resonance Imaging (MRI) systems. Mechanical coolers typically utilize a thermodynamic cycle (often involving the compression and expansion of a fluid) to shift heat and create cold portions that are useful for cooling. Cryocoolers are a class of mechanical coolers that can achieve cold temperatures in the cryogenic range (e.g., <~123 K). Different types of mechanical coolers may comprise various valves, thermal compressors, mechanical compressors, displacers, etc., to bring about expansion and compression of the working fluid.

A pulse tube cooler includes a stationary regenerator connected to a pulse tube. A reservoir or buffer volume may be connected to the opposite end of the pulse tube via a phase control device such as a sharp-edged orifice or an inertance tube. The reservoir, pulse tube, and regenerator may be filled with a working fluid (e.g., a gas such as helium). A compressor (e.g., a piston) compresses and warms a parcel of the working fluid. The compressed working fluid is forced through the regenerator, where part of the heat from the compression ($Q_o$) is removed at ambient temperature and stored at the regenerator. The working fluid is then expanded through the pulse tube and the phase control device into the reservoir. This expansion provides further cooling ($Q_c$) that takes place at a cold temperature ($T_c$). The cooling occurs at a cold end of the pulse tube nearest the regenerator. A hot end of the pulse tube farthest from the regenerator collects heat.

Pulse tube cryocoolers do not have moving parts at the cold end, such as displacer pistons or valves. To achieve the desired cooling, the combination of the phase control device and the reservoir cause a phase shift between mass waves and pressure waves generated by the compressor. By restricting or slowing the mass flow to the buffer volume, the phase control device may serve to shift the phase of the mass flow relative to the pressure wave generated by the compressor.

Multistage pulse tube coolers are used to achieve temperatures colder than can be achieved with a single cooler alone. Multistage coolers can be arranged in series, where the cold end of the first cooler is connected to the hot end of the second pulse tube, or in parallel, where the cold end of the first stage is connected to the cold end of the second stage. Some load shifting between stages can be brought about by varying the frequency, charge pressure and/or temperature of each stage.

SUMMARY

Various embodiments are directed to multistage pulse tube coolers. In some embodiments, one or more stages of the pulse tube cooler may comprise a control valve positioned between the hot end of the pulse tube and the reservoir. Also, in various embodiments, one or more inter-stage control valves may be positioned between the pulse tubes of consecutive stages.

FIGURES

Various embodiments of the present invention are described here by way of example in conjunction with the following figures, wherein.

DESCRIPTION

Figure 1:
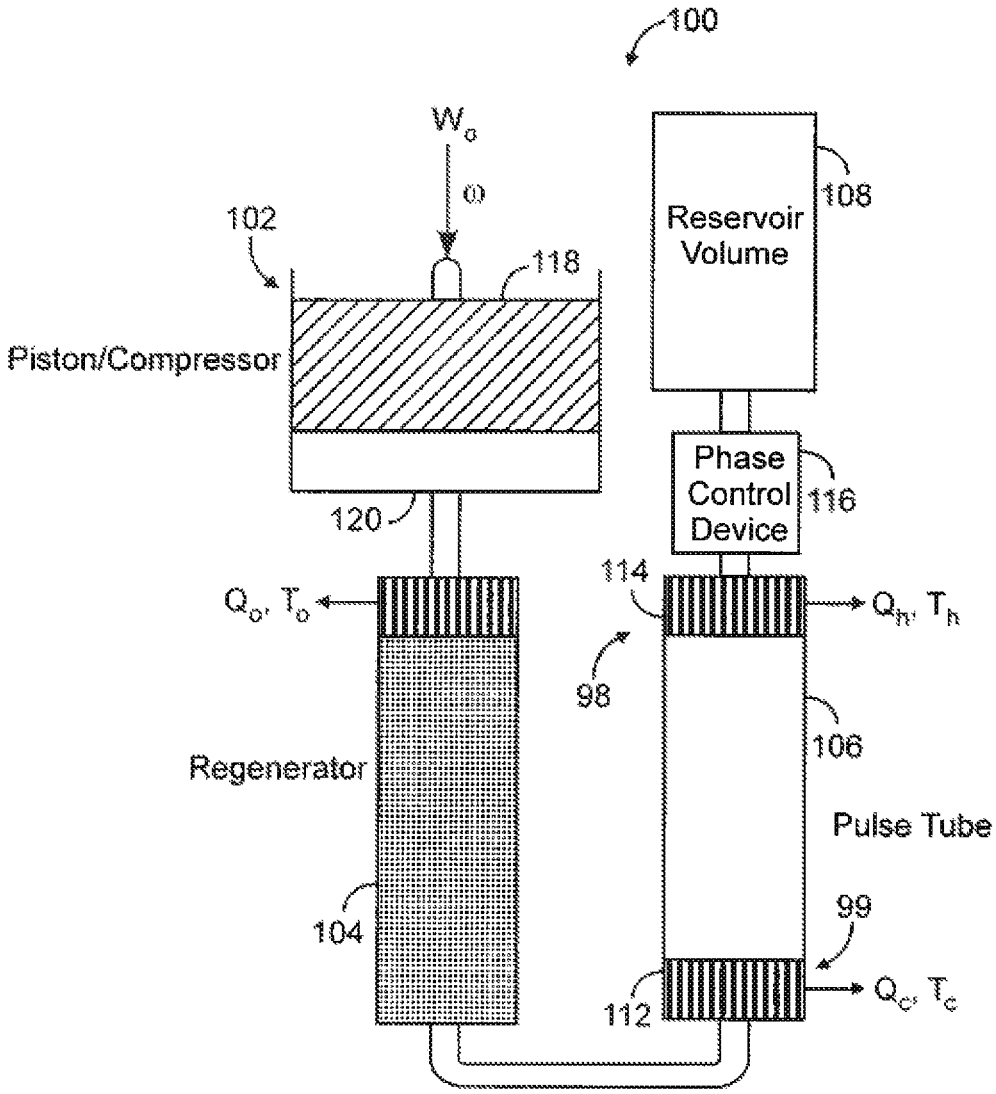
FIG. 1 illustrates one embodiment of a pulse tube cooler.

FIG. 1 illustrates one embodiment of a pulse tube cooler 100. The cooler 100 comprises various components in fluid communication with one another and filled with a working fluid (e.g., helium gas). For example, the cooler 100 may comprise a compressor 102 for providing pressure/volume (PV) work. The compressor 102 may be of any suitable compressor type and, in various embodiments, may be a linear compressor or rotary compressor. In various embodiments, the compressor 102 may comprise a piston 118 and a cylinder 120. In addition, the cooler 100 may comprise a regenerator 104, a pulse tube 106 and a reservoir 108. A first heat exchanger 110 may be positioned between the compressor 102 and the regenerator 104. A cold end heat exchanger 112 may be positioned at a cold end 99 of the pulse tube 106 near the regenerator 104. A hot end heat exchanger 114 is positioned at a hot end 98 of the pulse tube 106 near the reservoir 108. The reservoir 108 and the pulse tube 106 may be connected by a phase control device 116 that may comprise one or more sub-devices having an inertance and/or a resistance to the flow of working fluid, as described below. The phase control device 116 may be embodied as one or more separate components, as a portion of the pulse tube 106, as a portion of the reservoir 108, or as any combination thereof.

The compressor 102, may drive the thermodynamic cycle of the cooler 100 at various frequencies. For example, in various embodiments, one thermodynamic cycle of the cooler 100 may correspond to one complete cycle of the piston 102 or other mechanism of the compressor 102. According to the thermodynamic cycle of the cooler 100, the compressor 102 may provide work $W_o$ to compress a portion of the working fluid, adding heat $Q_o$ and causing the temperature $T_o$ of the working fluid to rise at heat exchanger 110. As the compressor 102 further compresses the working fluid, warm working fluid is passed through the regenerator 104 where part of the heat of compression $Q_o$ is removed and stored. Working fluid already present in the pulse tube 106 may be at a relatively lower pressure than that entering the pulse tube via 106 via the regenerator 104. Accordingly, the working fluid entering the pulse tube 106 via the regenerator 104 may expand in the pulse tube 106, causing cooling $Q_c$ at the exchanger 112 at a temperature $T_c$. Excess pressure in the pulse tube 106 from the expansion may be relieved across the phase control device 116 into the reservoir. As the cycle continues, the compressor 102 begins to draw the working fluid from the cold end 99 of the pulse tube 106 back through the regenerator 104, where the stored heat is reintroduced. Resulting low pressure in the pulse tube 106 also causes working fluid from the reservoir 108 to be drawn across the phase control device 116 into the pulse tube 106. This working fluid from the reservoir 108 is at a higher pressure than that already in the pulse tube 106 and, therefore, enters with heat energy $Q_h$ and at a temperature $T_h$ that is relatively warmer than that of the other working fluid in the pulse tube 106. A new cycle may begin as the compressor 102 again reverses and begins to compress the working fluid. Examples of the operation of pulse tube coolers are provided in commonly assigned U.S. Patent Application Publication Nos. 2009/0084114, 2009/0084115 and 2009/0084116, which are incorporated herein by reference in their entirety.

The performance of the pulse tube cooler 100 depends on the generated phase shift between the pressure waves and mass flow waves generated by the compressor 102 in the working fluid. This phase shift is a function of the volume of the reservoir 108 and the inertance and/or flow resistance of the phase control device 116. To achieve optimal performance, the phase shift should be approximately 0°, or slightly negative, such that the mass wave and pressure wave roughly coincide at the coldest portion of the pulse tube 106 (e.g., the cold end 99). According to various embodiments, the mechanical/fluid flow properties causing the phase shift may behave in a fashion analogous to the properties of an inductor-resistor-capacitor (LRC) electronic circuit that cause phase shifts between voltage and current. In the context of the pulse tube cooler 100, resistance is analogous to the flow resistance impedance caused by the phase control device 116. Inductance is analogous to the inertance introduced by the phase control device 116. Capacitance is analogous to the heat capacity of the system and is a function of the geometry of the reservoir 108 and the heat capacity of the working fluid.

Figure 2:
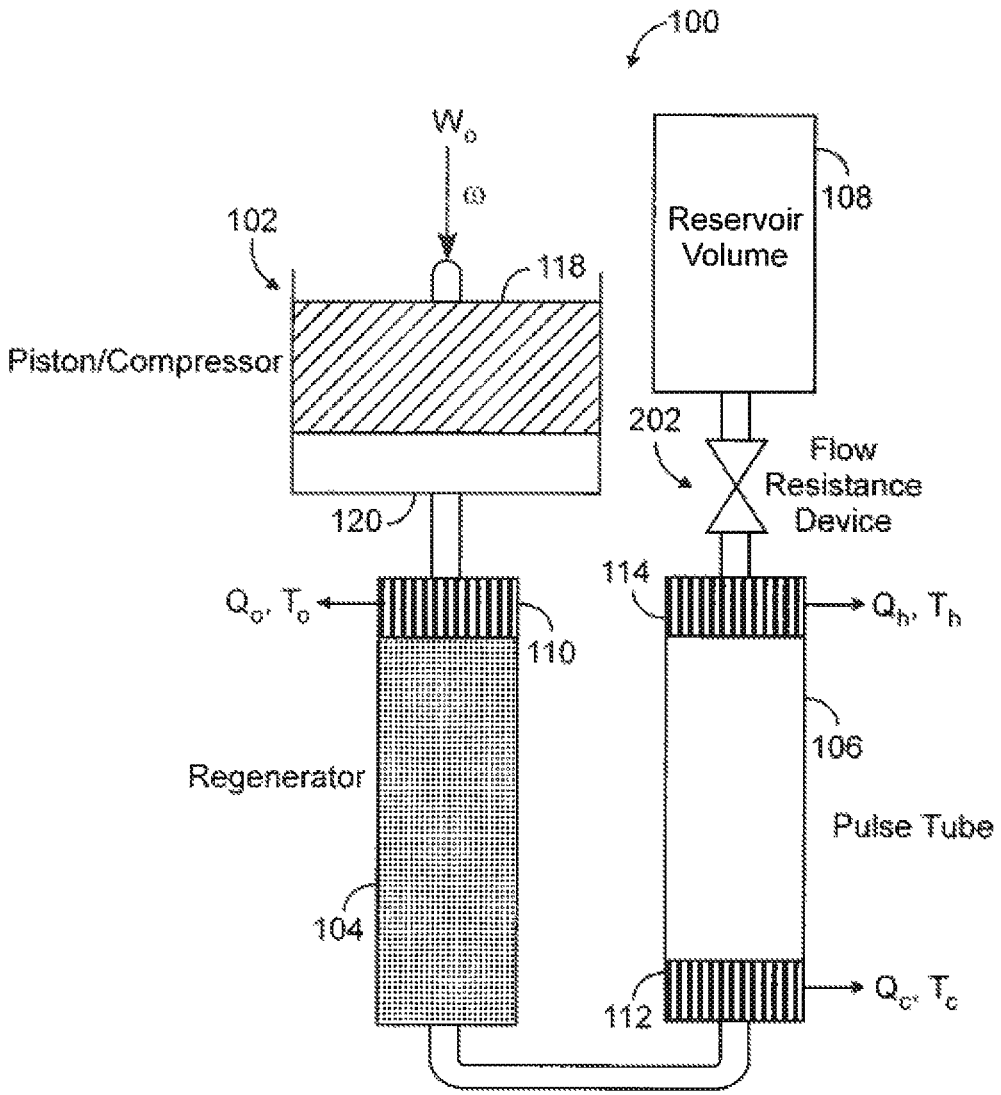
FIG. 2 illustrates one embodiment of the cooler of FIG. 1 where the phase control device comprises an orifice.

According to various embodiments, the phase control device 116 may comprise various components that introduce resistance and or inertance into the system. For example, FIG. 2 illustrates one embodiment of the cooler 100 where the phase control device 116 consists of a flow resistive orifice 202. The orifice 202 resists the flow of working fluid from the pulse tube 106 to the reservoir 108, thus contributing to the phase shift between the pressure wave and mass wave. The flow resistance provided by the orifice 202 may be a function of the size and shape of the orifice. For example, for a circular orifice 202, the resistance may depend on the orifice diameter. The orifice 202 may be embodied as a part of the pulse tube 106, a part of the reservoir 106, a separate component, or any combination thereof. It will be appreciated that a resistive orifice 202 may be associated with an irreversible energy loss that can serve as a drag on efficiency.

Figure 3:
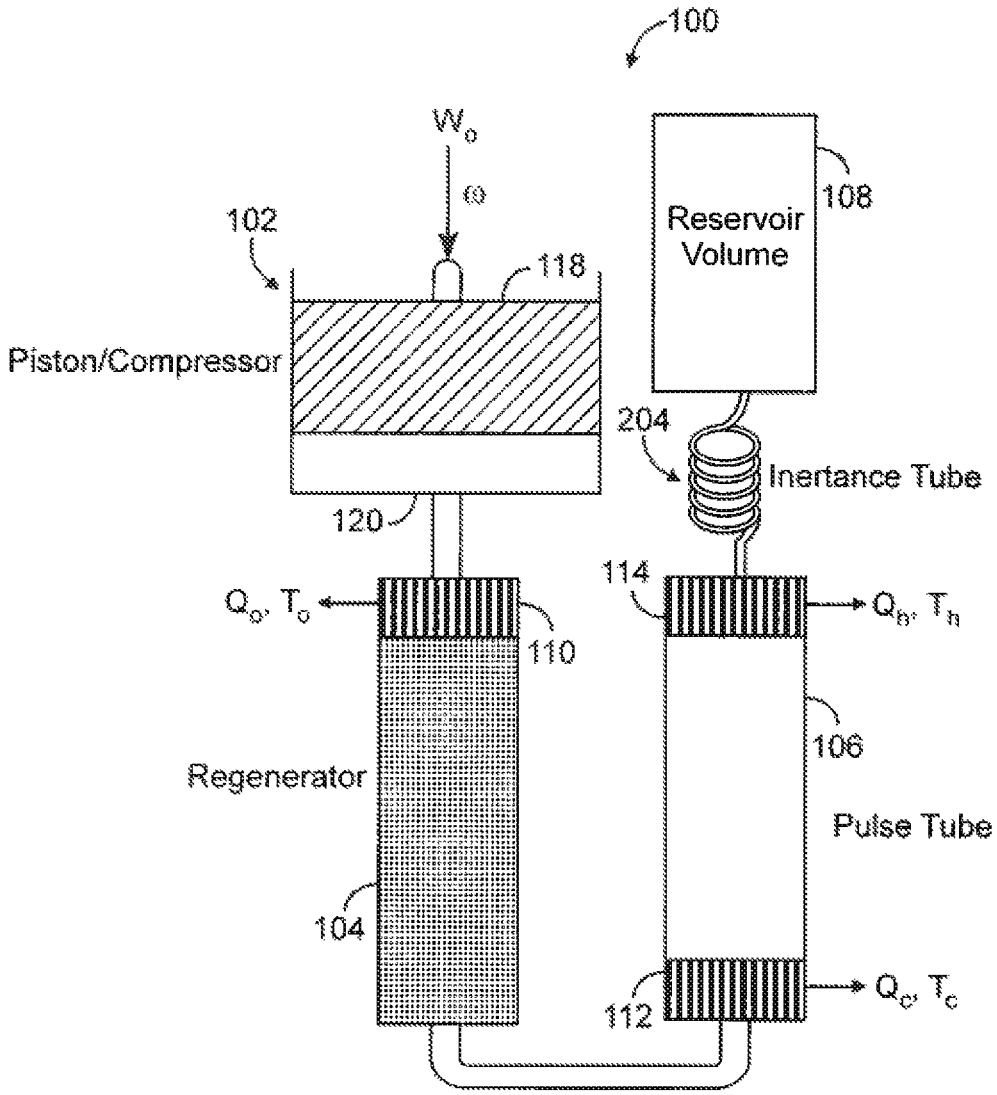
FIG. 3 illustrates one embodiment of the cooler of FIG. 1 where the phase control device comprises an inertance tube

FIG. 3 illustrates one embodiment of the cooler 100 where the phase control device 116 comprises an inertance tube 204. The inertance tube 204 may be several meters in length, which may be coiled, as shown in FIG. 3, or straight. By increasing the distance that the working fluid must traverse between the pulse tube 106 and the reservoir 108, the inertance tube 204 may increase the time that the working fluid takes to reach the reservoir 108, while only minimally affecting the timing of the pressure wave. In this way, the inertance tube 204 may introduce a phase shift between the pressure wave and the mass wave. For the inertance tube geometry shown in FIG. 3, the inertance (L) and flow resistance (R) of the tube 204 may be given by Equations 1 and 2 below where $l_t$ d and v, respectively, are the length, diameter and internal volume of the inertance tube 204.

$$L = \frac{4l_t}{\pi \times d^2} \tag{1}$$

$$R = \frac{128 l_t \eta}{(\pi \times \rho \times d^4)} \tag{2}$$

The inertance tube 204 may be embodied as a portion of the pulse tube 106, a portion of the reservoir 108, a separate component, or any combination thereof.

Figure 4:
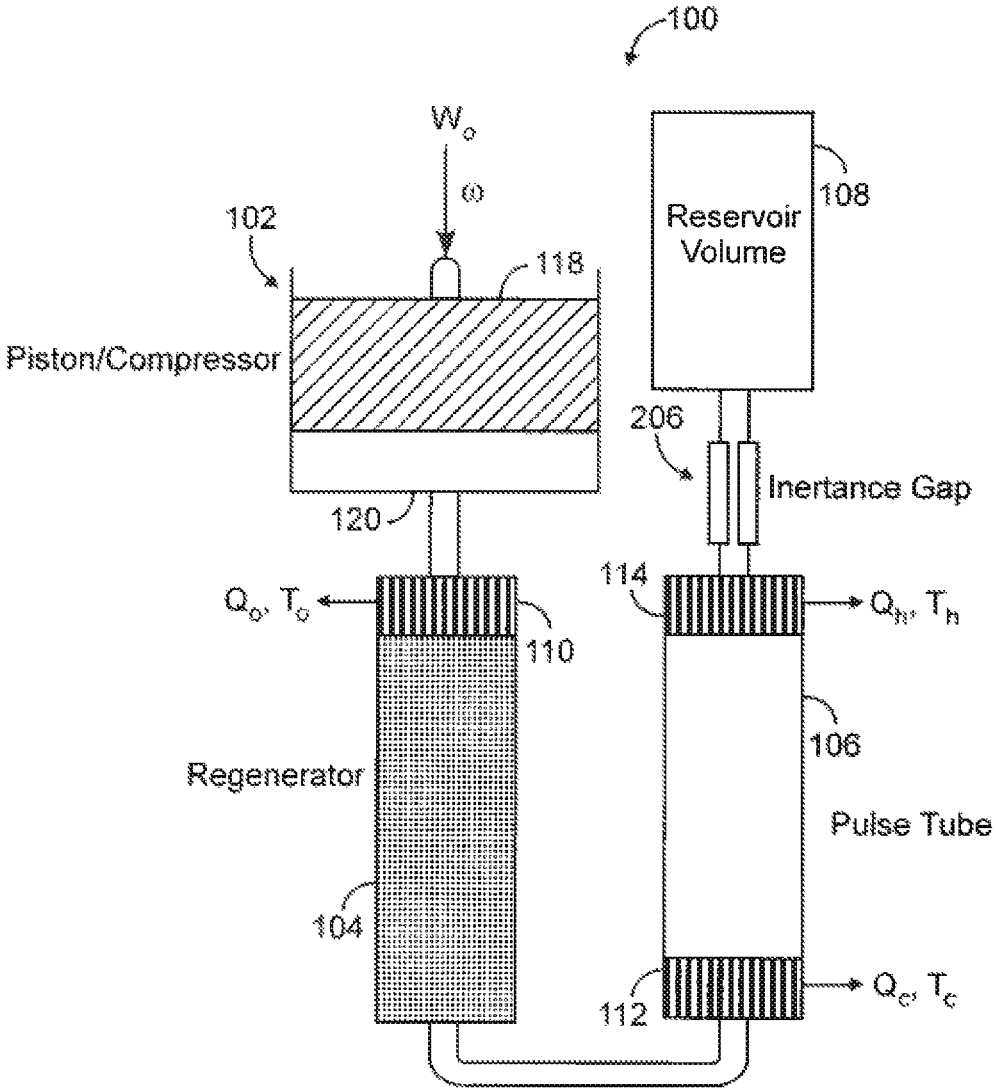
FIG. 4 illustrates one embodiment of the cooler of FIG. 1 where the phase control device comprises an inertance gap device.
Figure 5:
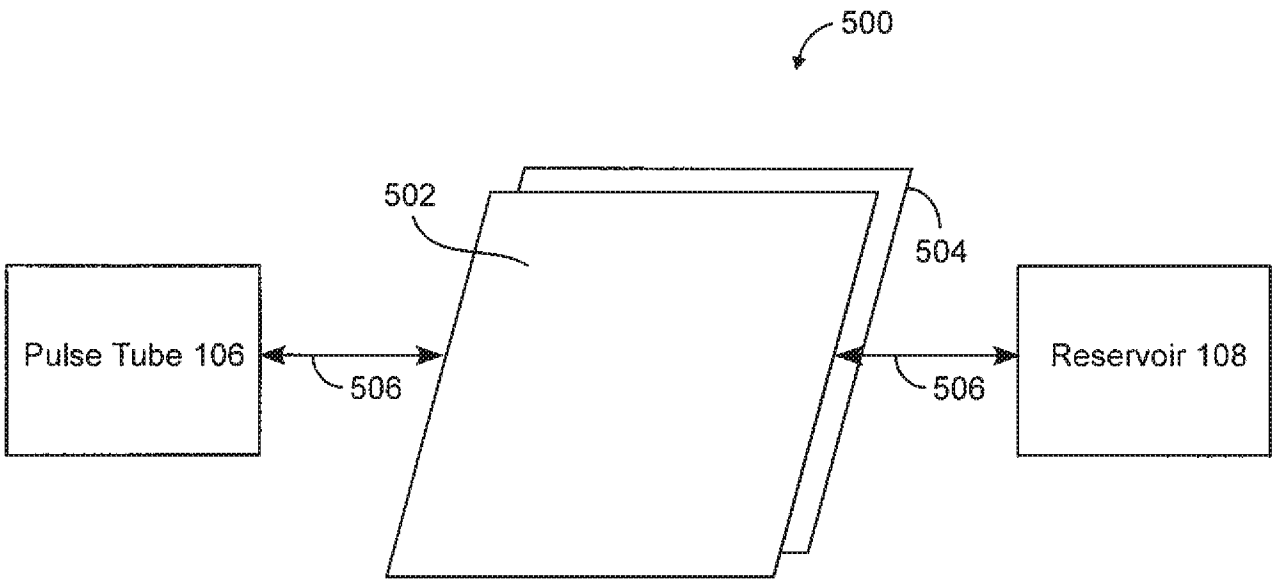
FIG. 5 illustrates one example configuration of an inertance gap device comprising parallel plates.

FIG. 4 illustrates one embodiment of the cooler 100 where the phase control device 116 comprises an inertance gap device 206. The inertance gap device 206 may be a portion of the pulse tube 106, a portion of the reservoir 108, a separate component, or any combination thereof. The inertance gap device 206 may behave similarly to the inertance tube 204, but may have smaller physical dimensions. For example, while the intertance tube 204 may be several meters long, the inertance gap device 206 may have a length on the order of several inches. FIG. 5 illustrates one example configuration of an inertance gap device 500 comprising parallel plates 502, 504. The working fluid of the cooler 100 may pass between the parallel plates 502 as it travels between the pulse tube 106 and the reservoir 108. The path of the working fluid through the inertance gap device 500 is indicated by arrows 506. The inertance and flow resistance of the inertance gap geometry shown in FIG. 5 are given by Equations 3 and 4 below, where $l_g$, w and s are the length, width, and thickness of the gap.

$$L = \frac{l_g}{w \times s} \tag{3}$$

$$R = \frac{12 l_g \eta}{\rho \times w \times s^3} \tag{4}$$

Figure 6:
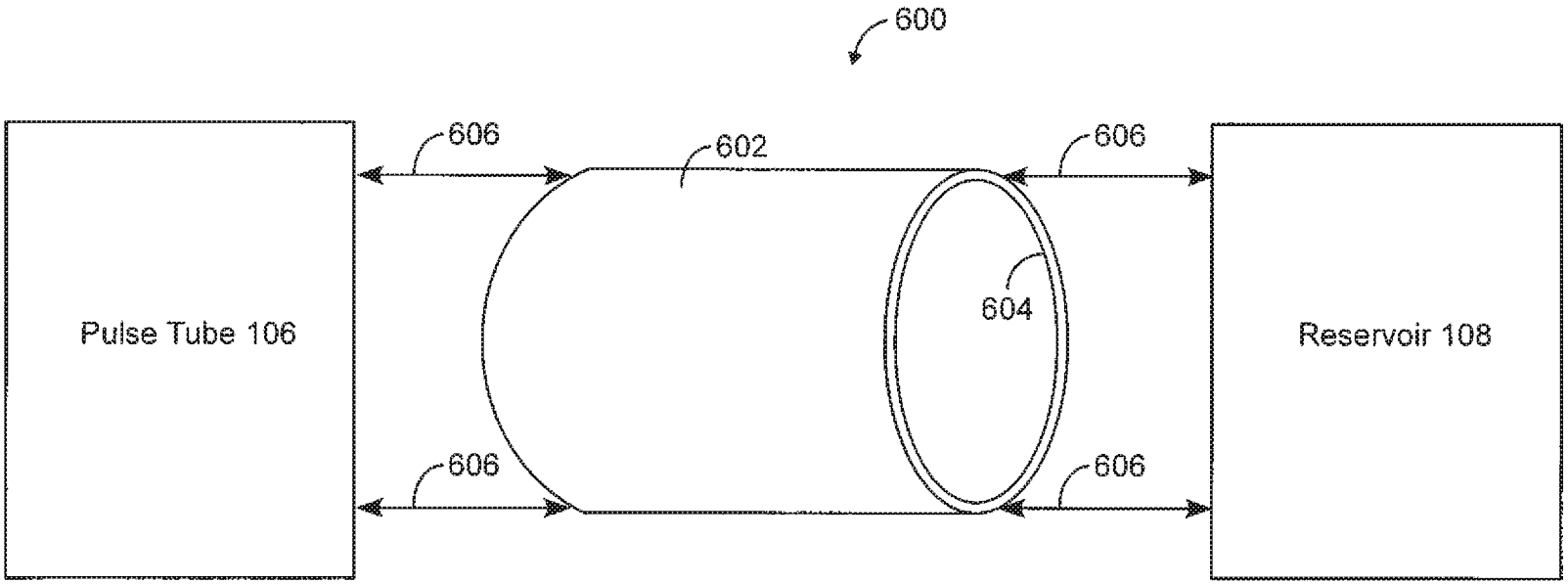
FIG. 6 illustrates one example configuration of an inertance gap device comprising concentric tubes.

FIG. 6 illustrates another example configuration of an inertance gap device 600 comprising concentric tubes 602, 604. The working fluid passes between the tubes on its way from the pulse tube 106 to the reservoir 108 and back. The direction of the working fluid is indicated by arrows 606. The inertance and resistance of the gap geometry shown in FIG. 6 may be a function of the distance between the two concentric tubes 602, 604 and the length of the device 600.

Figure 7:
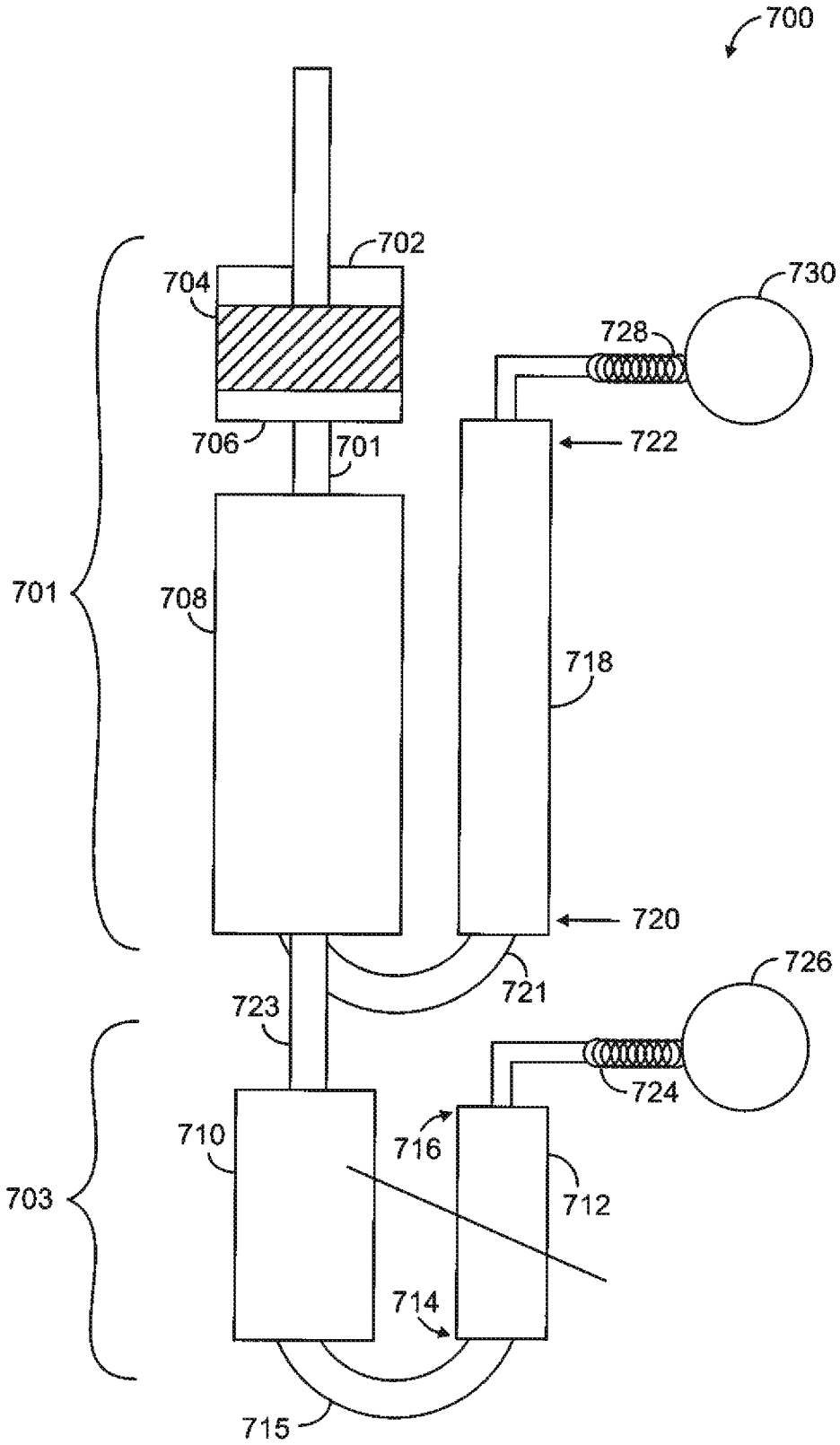
FIG. 7 illustrates one embodiment of a multistage pulse tube cooler with two stages.

To decrease cold end temperature, it may be desirable to combine multiple pulse tube coolers into a multistage cooler. FIG. 7 illustrates one embodiment of a multistage pulse tube cooler with two stages, 701, 703. A compressor 702 may comprise a piston 706 and a cylinder 706. The first stage 701 comprises a first stage regenerator 708, a first stage reservoir 730 and a first stage pulse tube 718 having a cold end 720 and a hot end 722. The compressor 702 and the first stage regenerator may be in fluid communication with one another, for example, via a tube 701. The pulse tube 718 and reservoir 730 are connected via a first stage phase control device 728, which may be a flow resistive orifice and/or an inertance device (e.g., tube or gap). The second stage 703 may comprise a second stage regenerator 710, a second stage reservoir 726 and a second stage pulse tube 712, which may have a hot end 716 and a cold end 714. The cold end 714 of the second stage pulse tube 712 may be in fluid communication with the second stage regenerator 710, for example, via tube 715. The second stage pulse tube 712 and the second stage reservoir 726 may also be connected via a phase control device 724. The phase control device 724, like the device 728, may be a flow resistive orifice and/or an inertance tube or gap. The cold end 720 of the first stage pulse tube 718 is in fluid communication with the second stage regenerator 710. For example, in the embodiment shown in FIG. 7, the cold end 720 of the first stage pulse tube 718 is connected to the second stage regenerator via tubes 721 and 723. Although only two stages are shown, it will be appreciated that coolers may be constructed with an arbitrary number of stages.

Figure 8:
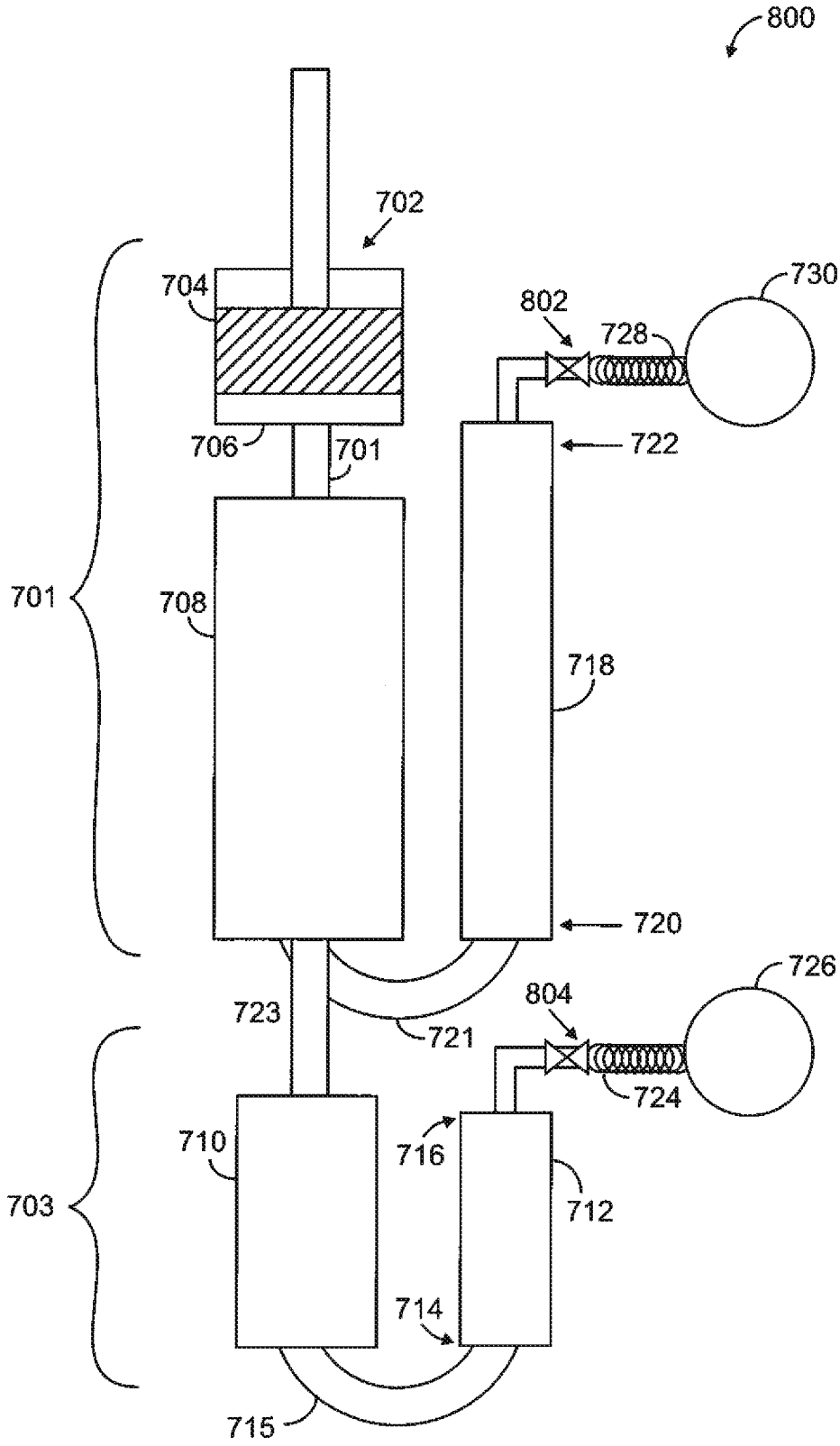
FIG. 8 illustrates one embodiment of a multistage pulse tube cooler having control valves positioned between the respective pulse tubes and the reservoirs.

FIG. 8 illustrates one embodiment of a multistage pulse tube cooler 800 having control valves 802, 804 positioned between the respective pulse tubes 712, 718 and the reservoirs 726, 730. The control valves 802, 804 may be any suitable type of valve or variable diameter orifice. For example, in various embodiments, one or both of the valves 802, 804 may be needle-type valves. As shown, the control valves 802, 804 are separated from the respective reservoirs 730, 726 via the phase control devices 728, 724. It will be appreciated, however, that the positions of the phase control devices 728, 724 and the control valves 804, 802 may be reversed. According to various embodiments, tuning the control valves 802, 804 may affect the relative cooling loads of the stages 701, 703.

The control valves 802, 804 may act as flow resistive orifices and/or inertance gaps. Accordingly, changing the positions of the valves 802, 804 may change the resistance and/or inertance between the pulse tubes 718, 712 and their respective reservoirs 730, 726. As the relative resistance and/or inertance values for each of the stages 701, 703 changes, the relative cooling load between the stages 701, 703 may also change. Accordingly, optimizing the positions of the valves 802, 804 may also have the effect of optimizing the cooling load between the stages 701, 703.

Figure 8A:
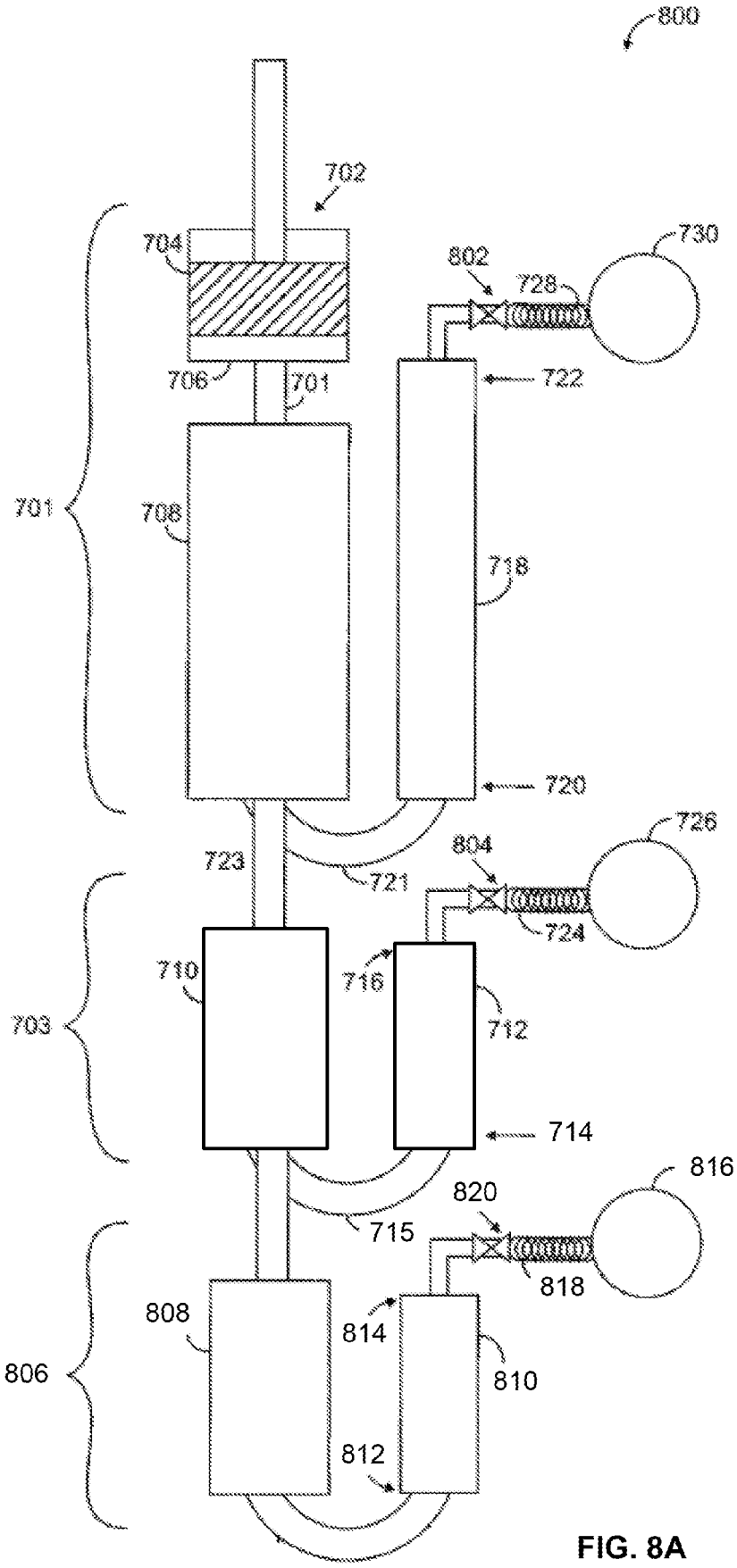
FIG. 8A illustrates one embodiment of the multistage pulse tube cooler of FIG. 8 comprising a third stage.

FIG. 8A illustrates one embodiment of the multistage pulse tube cooler 800 of FIG. 8 comprising a third stage 806. The third stage 806 comprises a third stage regenerator 808 having a first end in fluid communication with the second stage regenerator 710 and a second end. A third stage pulse tube 810 comprises a cold end 812 in fluid communication with the second end of the third stage regenerator 808 and a hot end 814. A third stage reservoir 816 is in fluid communication with the hot end 814. A third stage phase control device 818 may be positioned between the third stage reservoir 816 and the third stage pulse tube 810. In some embodiments, the third stage 806 further comprises a stage control valve 820 also positioned between the third stage reservoir 816 and the third stage pulse tube 810.

Figure 9:
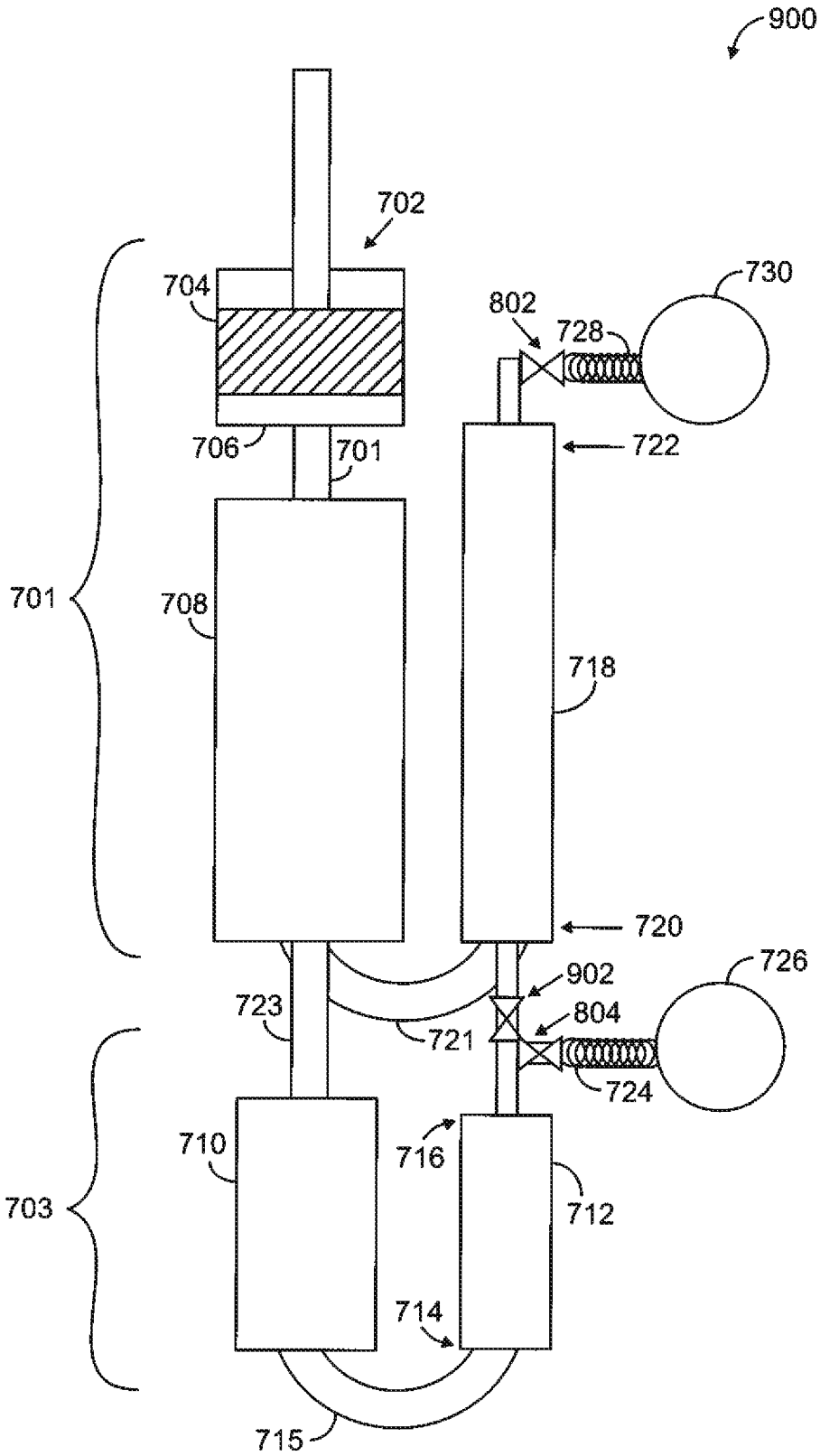
FIG. 9 illustrates one embodiment of a multistage pulse tube cooler having a control valve positioned between the pulse tubes of the stages.

FIG. 9 illustrates one embodiment of a multistage pulse tube cooler 900 having an inter-stage flow control device 902 positioned between the pulse tubes 708, 710 of the stages 701, 703. The flow control device 902 may be any sort of valve, variable diameter orifice, inertance device, or combination there of. For example, the flow control device 902 may be a needle valve. The flow control device 902, as shown, connects the cold end of the first stage pulse tube 718 to the hot end of the second stage pulse tube 712. In this way, the flow control device 902 may control and regulate fluid pressure exchange between the stages 701, 703. In use, the flow control device 902 may allow some of the pressure from the first stage 701 to bleed into the second stage 703. In this way, modifying the properties of the flow control device 902 may serve to shift the cooling load between the stages 701, 703. The cooler 900 is illustrated as including phase control devices 802, 803 between the respective pulse tubes 718, 712 and reservoirs 730, 726. It will be appreciated, however, that some embodiments including the flow control device 902 may omit one or both of the phase control devices 802, 804.

Figure 9A:
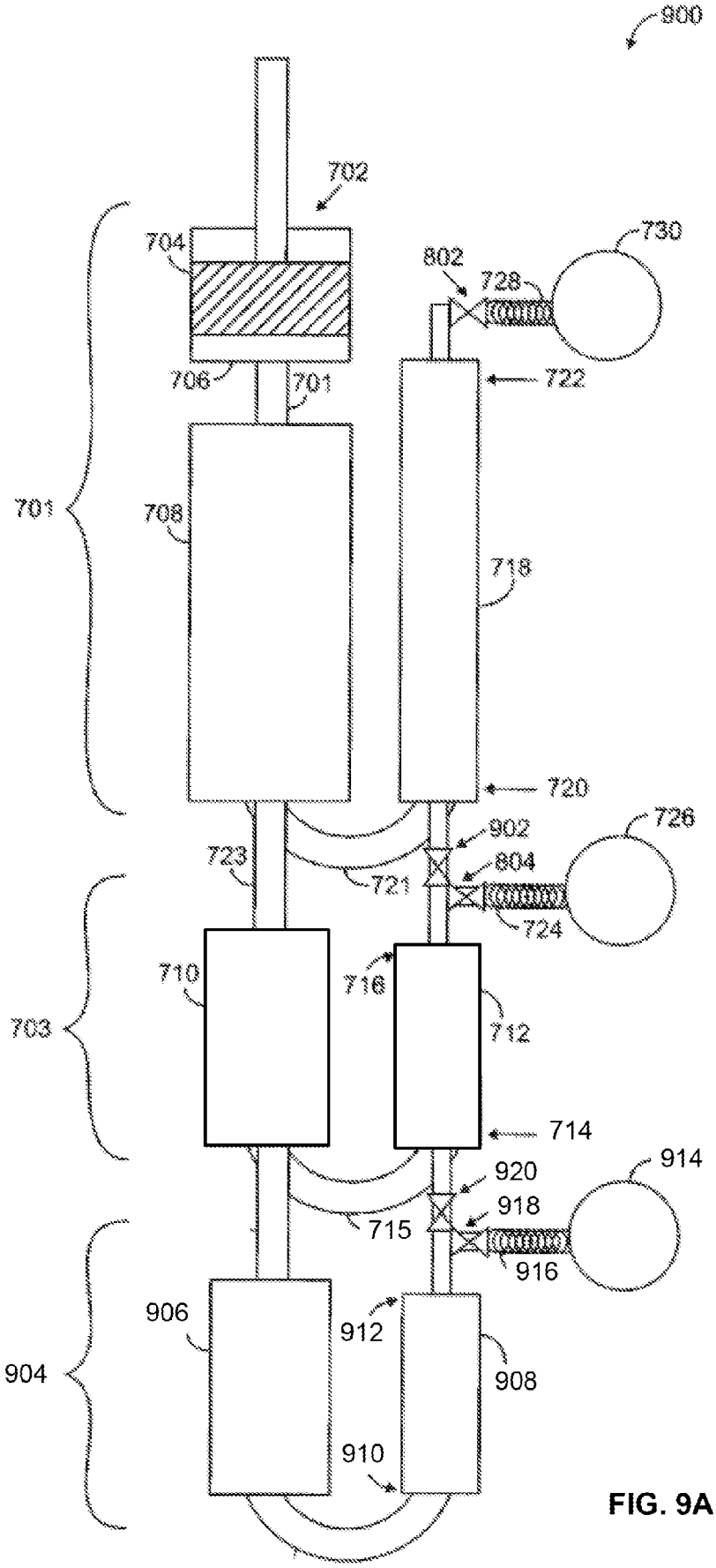
FIG. 9A illustrates one embodiment of the multistage pulse cooler of FIG. 9 comprising a third stage.

FIG. 9A illustrates one embodiment of the multistage pulse cooler 900 of FIG. 9 comprising a third stage 904. The third stage 904 may comprise a third stage regenerator 906 having a first end in fluid communication with the second stage regenerator 710 and a second end. A third stage pulse tube 908 comprises a cold end 910 in fluid communication with the second end of the third stage regenerator and a hot end 912. A third stage reservoir 914 may be in fluid communication with the hot end 912 of the third stage pulse tube 908. A third stage phase control device 916 may be positioned between the third stage reservoir 914 and the third stage pulse tube 908. In some embodiments, the third stage 904 further comprises a stage control valve 918 also positioned between the third stage reservoir 914 and the third stage pulse tube 908. Also, in some embodiments, the second stage pulse tube 712 and the third stage pulse tube 908 are in fluid communication via a second inter-stage control valve 920.

The SAGE software package available from Gedeon Associates of Athens, Ohio was used to model the coolers 700, 800, 900 shown in FIGS. 7, 8 and 9, respectively. According to the model, the first stage regenerator 708 was 13.93 centimeters (cm) in length and 8.29 cm in diameter. The first stage pulse tube 718 was 25.0 cm in length and 2.672 cm in diameter. The second stage regenerator 710 was 3.224 cm in length and 4.0 cm in diameter. The second stage pulse tube was 10.0 cm in length and 1.609 cm in diameter. The positions of the various valves 802, 804, 902 were optimized based on these dimensions by the SAGE software package.

Figure 10:
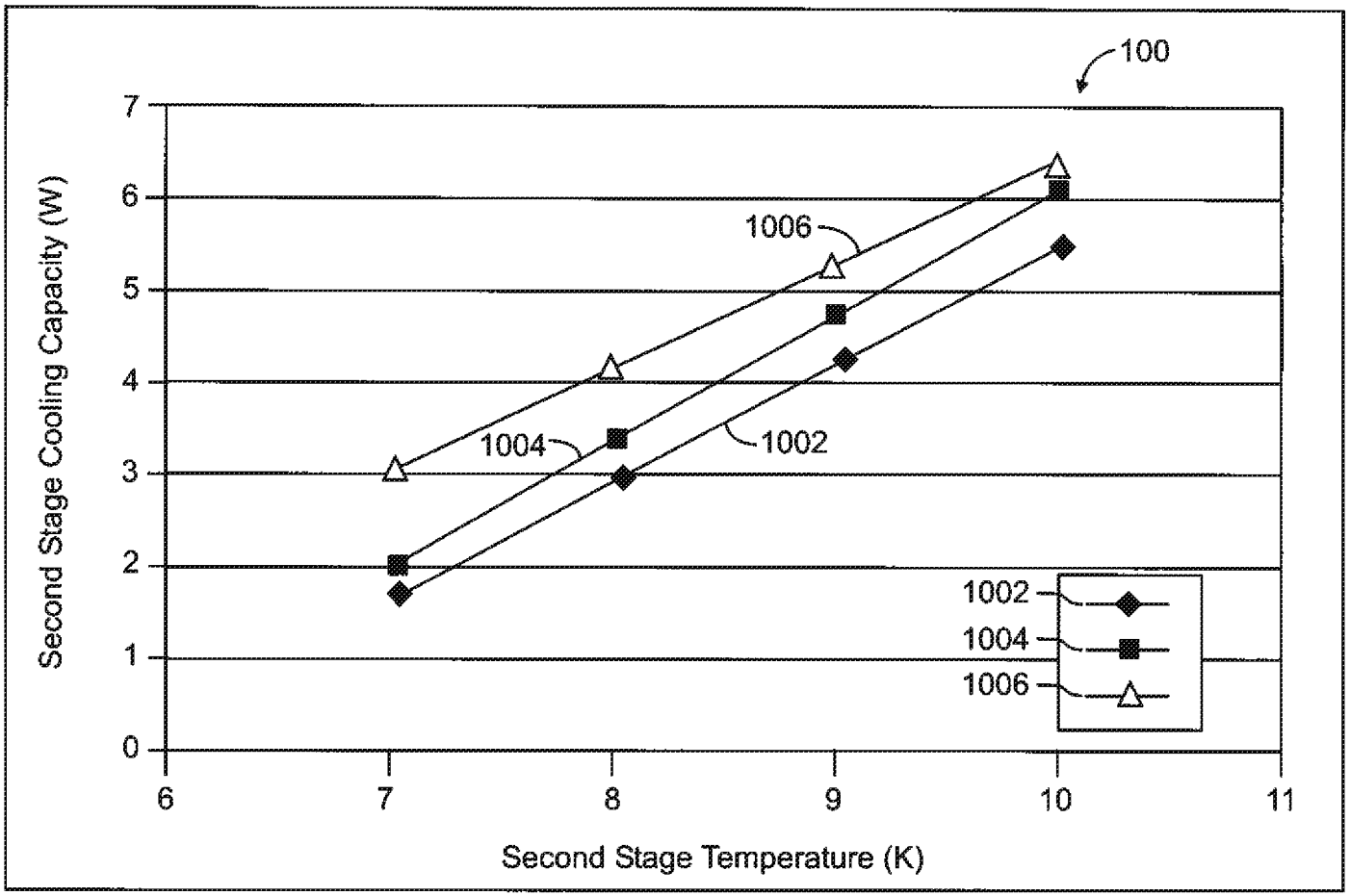
FIG. 10 is a chart showing results of a computer model of the multistage pulse tube coolers of FIGS. 7, 8 and 9.

FIG. 10 is a chart showing results of the SAGE software's model. Values on the x-axis represent the temperature at the cold end 714 of the second stage pulse tube 712. Values on the y-axis represent the second stage cooling capacity. It can be seen that the cooler 800 with the control valves 802, 804 exhibited greater cooling capacity than the multistage cooler 700 across the full range of second stage temperatures. The cooler 900 with the flow control device 902 between the respective pulse tubes 712, 718 performed better still with a greater cooling capacity than either of the coolers 700, 800 over the whole modeled range of second stage temperatures. The advantage of the cooler 900 was pronounced at lower second stage temperatures.

It is to be understood that the figures and descriptions of the present invention have been simplified to illustrate elements that are relevant for a clear understanding of the present invention, while eliminating other elements, for purposes of clarity. Those of ordinary skill in the art will recognize that these and other elements may be desirable. However, because such elements are well known in the art and because they do not facilitate a better understanding of the present invention, a discussion of such elements is not provided herein.

In various embodiments disclosed herein, a single component may be replaced by multiple components and multiple components may be replaced by a single component to perform a given function or functions. Except where such substitution would not be operative, such substitution is within the intended scope of the embodiments.

While various embodiments have been described herein, it should be apparent that various modifications, alterations, and adaptations to those embodiments may occur to persons skilled in the art with attainment of at least some of the advantages. The disclosed embodiments are therefore intended to include all such modifications, alterations, and adaptations without departing from the scope of the embodiments as set forth herein.

We claim:

1. A multistage pulse tube cooler comprising:

a compressor;

a first stage comprising:

a first stage regenerator comprising a first end in fluid communication with the compressor and a second end; and a first stage pulse tube comprising a cold end in fluid communication with the second end of the first stage regenerator and a hot end;

a first stage reservoir in fluid communication with the hot end of the first stage pulse tube;

a first stage control valve positioned between the first stage reservoir and the first stage pulse tube;

a first stage phase control device positioned between the first stage reservoir and the first stage pulse tube; and a second stage comprising:

a second stage regenerator having a first end in fluid communication with the second end of the first stage regenerator and a second end; and a second stage pulse tube comprising a cold end in fluid communication with the second end of the second stage regenerator and a hot end;

a second stage reservoir in fluid communication with the hot end of the second stage pulse tube;

a second stage control valve positioned between the second stage reservoir and the second stage pulse tube; and a second stage phase control device positioned between the second stage reservoir and the second stage pulse tube, wherein the cold end of the first stage pulse tube and the hot end of the second stage pulse tube are in fluid communication via an inter-stage flow control device, wherein the inter-stage control valve is positioned between the cold end of the first stage pulse tube and second stage control valve.

2. The cooler of claim 1, wherein first stage control valve is positioned between the hot end of the first stage pulse tube and the first stage phase control device.

3. The cooler of claim 1, wherein the first stage phase control device comprises a flow resistive device.

4. The cooler of claim 3, wherein the first stage phase control device defines an orifice.

5. The cooler of claim 1, wherein the first stage phase control device comprises an inertance device.

6. The cooler of claim 1, wherein the first stage phase control device comprises at least one device selected from the group consisting of a concentric inertance gap, a parallel plate inertance gap and an inertance tube.

7. The cooler of claim 1, wherein at least one of the first stage control valve and the second stage control valve comprises a needle valve.

8. The cooler of claim 1, further comprising:

a third stage comprising:

a third stage regenerator comprising a first end in fluid communication with the second end of the second regenerator and a second end; and a third stage pulse tube comprising a cold end in fluid communication with the second end of the third stage regenerator and a hot end;

a third stage reservoir in fluid communication with the hot end of the third stage pulse tube; and a third stage phase control device positioned between the third stage reservoir and the third stage pulse tube.

9. The cooler of claim 8, wherein the third stage further comprises a third stage control valve positioned between the third stage reservoir and the third stage pulse tube.

10. A multistage pulse tube cooler comprising:

a compressor;

a first stage comprising:

a first stage regenerator comprising a first end in fluid communication with the compressor and a second end; and a first stage pulse tube comprising a cold end in fluid communication with the second end of the first stage regenerator and a hot end;

a first stage reservoir in fluid communication with the hot end of the first stage pulse tube; and a first stage control valve positioned between the first stage reservoir and the first stage pulse tube; and a second stage comprising:

a second stage regenerator having a first end in fluid communication with the second end of the first stage regenerator and a second end; and a second stage pulse tube comprising a cold end in fluid communication with the second end of the second stage regenerator and a hot end; a second stage reservoir in fluid communication with the hot end of the second stage pulse tube; and a second stage control valve positioned between the second stage reservoir and the second stage pulse tube;

wherein the cold end of the first stage pulse tube and the hot end of the second stage pulse tube are in fluid communication via an inter-stage flow control device; and wherein the inter-stage control valve is positioned between the cold end of the first stage pulse tube and second stage control valve.

11. The cooler of claim 10, wherein the first stage further comprises:

a first stage phase control device positioned between the first stage reservoir and the first stage pulse tube; and wherein the second stage further comprises:

a second stage phase control device positioned between the second stage reservoir and the second stage pulse tube.

12. The cooler of claim 11, wherein first stage control valve is positioned between the hot end of the first stage pulse tube and the first stage phase control device.

13. The cooler of claim 11, wherein the first stage phase control device comprises a flow resistive device.

14. The cooler of claim 13, wherein the first stage phase control device defines an orifice.

15. The cooler of claim 11, wherein the first stage phase control device comprises an inertance device.

16. The cooler of claim 11, wherein the first stage phase control device comprises at least one device selected from the group consisting of a concentric inertance gap, a parallel plate inertance gap and an inertance tube.

17. The cooler of claim 4, wherein the inter-stage flow control device comprises a needle valve.

18. The cooler of claim 10, further comprising:

a third stage comprising:

a third stage regenerator having a first end in fluid communication with the second end of the second stage regenerator and a second end; and a third stage pulse tube comprising a cold end in fluid communication with the second end of the third stage regenerator and a hot end;

a third stage reservoir in fluid communication with the hot end of the third stage pulse tube.

19. The cooler of claim 18, wherein the cold end of the second stage pulse tube and the hot end of the third stage pulse tube are in fluid communication via a second inter-stage control valve.

20. The cooler of claim 10, wherein the inter-stage flow control device comprises an intertance device.

* * * * *